US011391307B2

(12) United States Patent
Argenziano et al.

(10) Patent No.: US 11,391,307 B2
(45) Date of Patent: Jul. 19, 2022

(54) HYDRAULIC TANK PROTECTION SYSTEM

(71) Applicant: Caterpillar Paving Products Inc., Brooklyn Park, MN (US)

(72) Inventors: Nicholas James Argenziano, Otsego, MN (US); Nicholas Aaron Greene, Elk River, MN (US); Todd M. Jennings, Ramsey, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 254 days.

(21) Appl. No.: 16/748,575

(22) Filed: Jan. 21, 2020

(65) Prior Publication Data

US 2021/0222710 A1 Jul. 22, 2021

(51) Int. Cl.

| | |
|---|---|
| ***E02F 9/08*** | (2006.01) |
| ***E02F 9/22*** | (2006.01) |
| ***F15B 21/041*** | (2019.01) |

(52) U.S. Cl.

CPC ..... *F15B 21/041* (2013.01); *E02F 9/0883* (2013.01); *E02F 9/226* (2013.01)

(58) Field of Classification Search

CPC ..... E02F 9/0883; E02F 9/226; F15B 19/005; F15B 20/00; F15B 21/005; F15B 21/041

See application file for complete search history.

(56) References Cited

U.S. PATENT DOCUMENTS

| | | | | |
|---|---|---|---|---|
| 6,257,210 | B1 | 7/2001 | Kim | |
| 7,647,844 | B2 | 1/2010 | Kawanishi et al. | |
| 9,797,288 | B2 | 10/2017 | Darr et al. | |
| 2004/0128107 | A1* | 7/2004 | Ryu | G01N 21/94 702/183 |
| 2011/0153275 | A1* | 6/2011 | Satake | G01N 21/534 702/184 |
| 2013/0292386 | A1* | 11/2013 | Klauer | E02F 9/0883 220/553 |
| 2017/0284060 | A1* | 10/2017 | Yamazaki | F01N 3/20 |

FOREIGN PATENT DOCUMENTS

| | | | |
|---|---|---|---|
| CN | 204572593 | U | 8/2015 |
| JP | 4847218 | B2 | 12/2011 |
| WO | 2014065260 | A1 | 5/2014 |

* cited by examiner

*Primary Examiner* — Kenneth Bomberg
*Assistant Examiner* — Matthew Wiblin
(74) *Attorney, Agent, or Firm* — Harrity & Harrity LLP; Jeff A. Greene

(57) ABSTRACT

A hydraulic tank protection system is disclosed. The hydraulic tank protection system may include a sensor to detect a characteristic of a fluid, a fluid control device to control a flow of the fluid into or out of a reservoir of a hydraulic tank, and an electronic control module to: receive, from the sensor, information indicating the characteristic of the fluid, determine, based on the characteristic of the fluid, whether the fluid comprises a first type of fluid, and selectively provide a control signal to actuate the fluid control device to control the flow of the fluid into or out of the reservoir based on whether the fluid comprises the first type of fluid.

20 Claims, 6 Drawing Sheets

HYDRAULIC TANK PROTECTION SYSTEM

The present disclosure relates generally to a hydraulic tank protection system and, for example, to a hydraulic tank protection system for preventing diesel exhaust fluid from entering a hydraulic system.

BACKGROUND

A hydraulic machine, such as, for example, a backhoe loader, a cold planer, a wheel loader, a compactor, a paver, a forest machine, a forwarder, a harvester, an excavator, an industrial loader, a tractor, a dozer, or another type of mining, construction, farming, robotic, and/or transportation equipment, may include a hydraulic system for using liquid fluid power to perform work. The hydraulic system may include a motor, a pump, a generator, a hydraulic tank or reservoir, a hydraulic cylinder, and/or the like. To utilize liquid fluid power to perform work, the hydraulic system may cause hydraulic fluid contained in the hydraulic tank to be pumped to the hydraulic cylinder.

Diesel exhaust fluid (DEF) is an aqueous urea solution that is commonly used to lower nitrogen oxide (NOx) concentration in diesel exhaust emissions from a diesel engine of a machine such as a hydraulic machine. DEF is stored in a tank on board a vehicle and injected into an exhaust stream by a metering system.

Commonly, an inlet or fill tube of the tank storing the DEF is positioned near an inlet or fill tube of a hydraulic tank of a hydraulic system. The proximity of the fill tube of the tank storing the DEF to the fill tube of the hydraulic tank may cause DEF fluid to be inadvertently added to the hydraulic tank and subsequently distributed throughout the hydraulic system. Although non-toxic, DEF can corrode some metals. Because DEF can corrode some metals, the addition of the DEF fluid to the hydraulic tank and/or the subsequent distribution of the DEF throughout the hydraulic system may cause the hydraulic system to be damaged. The damage caused to the hydraulic system may result in the repair and/or replacement of one or more components of, or the entire, hydraulic system.

One attempt to determine a type of fluid being utilized in a machine is disclosed in U.S. Pat. No. 7,647,844 B2 that issued to Toshiaki Kawanishi et al. on Jan. 19, 2010 ("the '844 patent"). In particular, the '844 patent discloses a flow rate/liquid type detecting method for detecting the flow rate of a fluid and, at the same time, detecting any one of or both the type of the fluid and the concentration of the fluid.

While the flow rate/liquid type detecting method of the '844 patent may detect a type of a fluid being utilized within a system, the '844 patent does not suggest that the flow rate/liquid type detecting method can prevent a fluid that may harm or damage the system from entering the system. Further, the '844 patent does not suggest a system that can prevent a fluid that may harm or damage a hydraulic system from entering the hydraulic system.

The hydraulic tank protection system of the present disclosure solves one or more of the problems set forth above and/or other problems in the art.

SUMMARY

According to some implementations, a method may include receiving, via a fill tube of a hydraulic tank, a fluid; determining, by a sensor, a characteristic of the fluid; determining, based on the characteristic of the fluid, whether the fluid comprises a first type of fluid; and selectively actuating a fluid control device to control a flow of the fluid into or out of a reservoir of the hydraulic tank based on whether the fluid comprises the first type of fluid.

According to some implementations, a machine may include a hydraulic tank and a protection system. The hydraulic tank may include a fill tube and a reservoir. The protection system may include a sensor to detect a characteristic of the fluid, a fluid control device to control a flow of the fluid into or out of the reservoir, and an electronic control module to receive, from the sensor, information indicating the characteristic of the fluid, determine, based on the characteristic of the fluid, whether the fluid comprises a first type of fluid, and selectively provide a control signal to actuate the fluid control device to control the flow of the fluid into or out of the reservoir based on whether the fluid comprises the first type of fluid.

According to some implementations, a system may include a hydraulic tank and a protection system. The hydraulic tank may include a reservoir and a fill tube. The fill tube may allow a fluid to flow into the reservoir. The protection system may include at least one of a first fluid control device to control a flow of the fluid into the reservoir or a second fluid control device to control a flow of the fluid out of the reservoir, a sensor to determine a characteristic of the fluid, and an electronic control module to receive a signal from the sensor, the signal indicating the characteristic of the fluid, determine, based on the characteristic of the fluid, that the fluid comprises a first type of fluid, and selectively provide, based on whether the fluid comprises the first type of fluid, a control signal to actuate the at least one of the first fluid control device or the second fluid control device.

DETAILED DESCRIPTION

Figure 1:
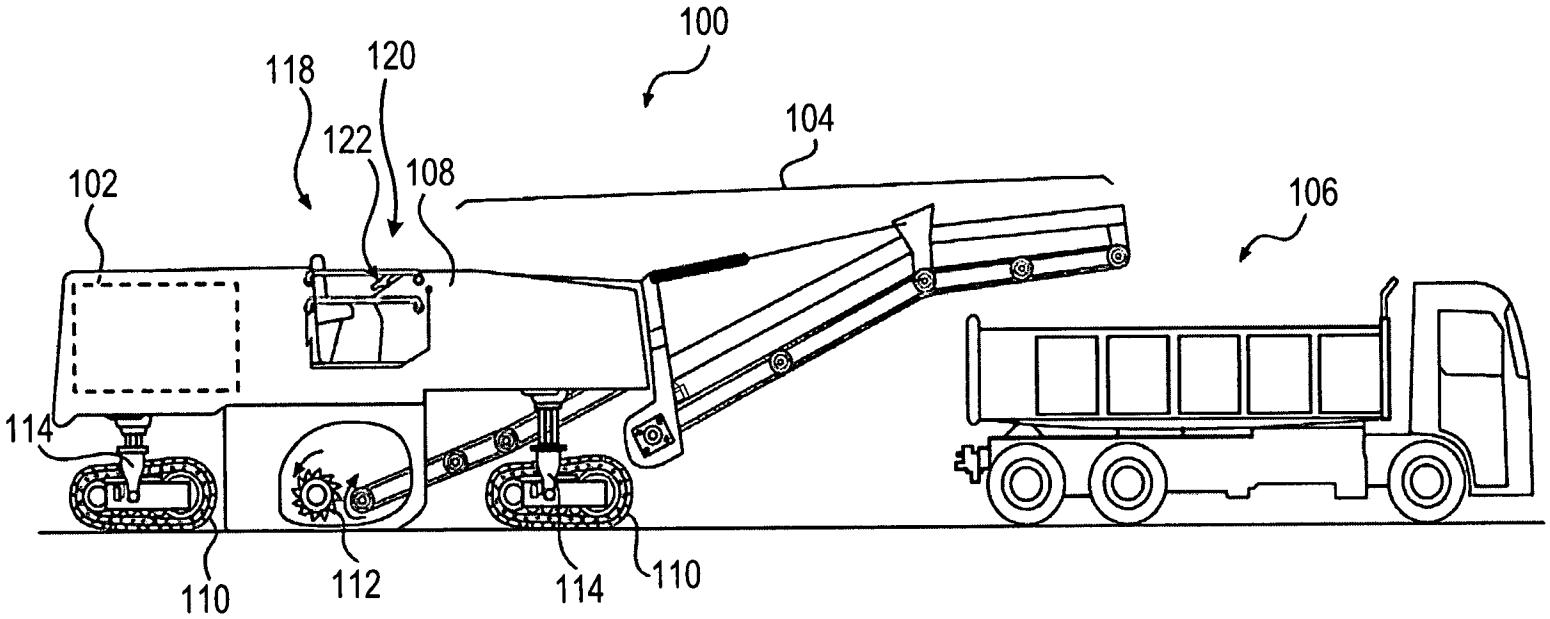
FIG. 1 is diagram of an example machine having a hydraulic system.

FIG. 1 is a diagram of an example a machine 100. In the example of FIG. 1, the machine 100 is a cold planer that includes a hydraulic system 102. The machine 100 is used to remove material, such as hardened asphalt, from a ground surface, such as a roadway. A conveyor system 104 may transfer the material from the ground surface to a haul vehicle 106 (e.g., a wagon or tractor trailer).

As shown in FIG. 1, the machine 100 has a frame 108 supported by one or more traction devices 110, a milling drum 112 rotationally supported under a belly of the frame 108, and an engine (not shown) mounted to the frame 108 and configured to drive traction devices 110 and milling drum 112. The traction devices 110 may include either wheels or tracks that are connected to actuators 114 of the hydraulic system 102 to controllably raise and lower frame 108 relative to a ground surface. The same or different actuators 114 may be used to steer the machine 100 and/or to adjust a travel speed of the traction devices 110. The conveyor system 104 is connected at a leading end to the frame 108 and is configured to transport material away from the milling drum 112 and into a receptacle, such as the haul vehicle 106. The frame 108 also supports an operator station 118. The operator station 118 houses a control console 120 with any number of interface devices 122 used to control the machine 100 and/or the hydraulic system 102.

As indicated above, FIG. 1 is provided as an example. Other examples may differ from what is described in connection with FIG. 1.

Figure 2:
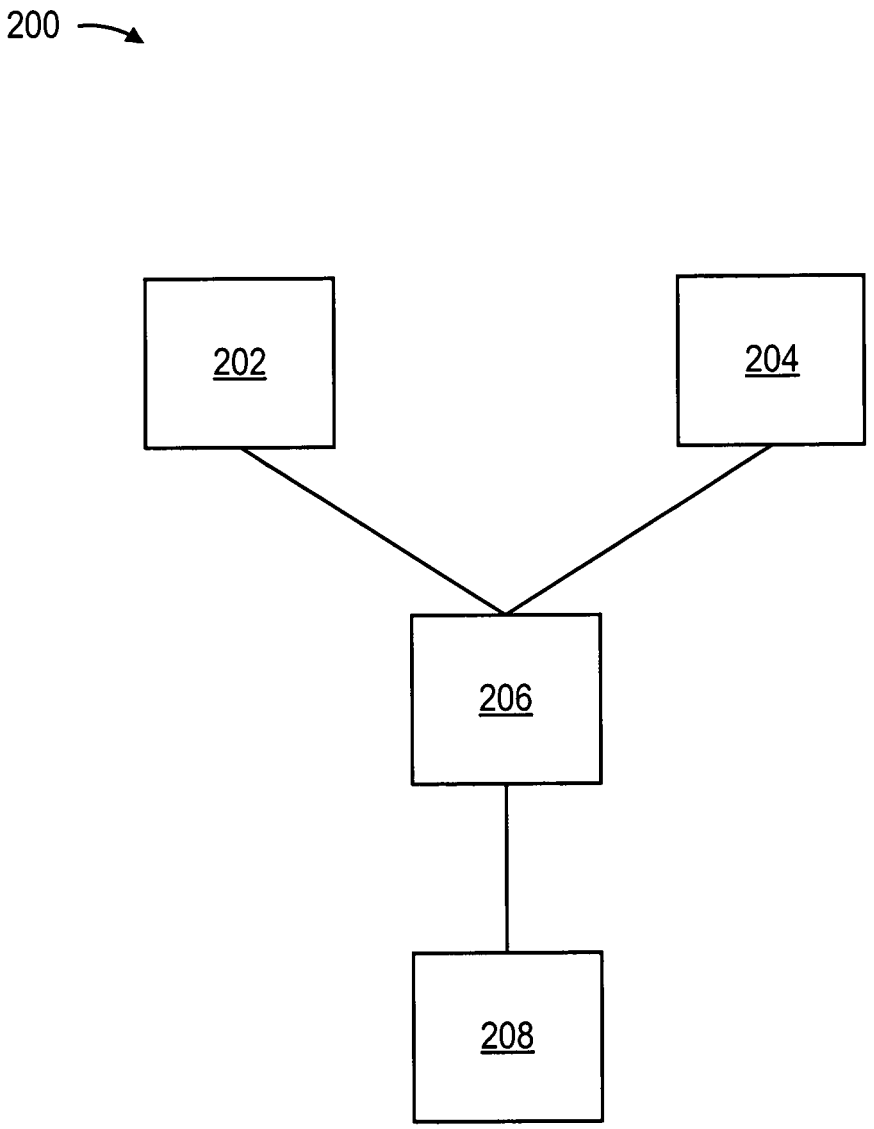
FIG. 2 is a diagram of an example hydraulic tank protection system.

FIG. 2 is a diagram of an example hydraulic tank protection system 200. The hydraulic tank protection system 200 may be configured to prevent an unwanted fluid, such as diesel exhaust fluid (DEF), from entering and/or exiting one or more portions of a hydraulic tank 300 (e.g., a reservoir 302 and/or a fill tube 304) (shown in FIGS. 3-5). As shown in FIG. 2, the hydraulic tank protection system 200 includes a sensor 202, a fluid control device 204, an electronic control module (ECM) 206, and/or an alert system 208.

The sensor 202 is a sensor device configured to detect a characteristic of a fluid and transmit information identifying the detected characteristic to the ECM 206. For example, the sensor 202 may be a pH sensor, an urea sensor, a liquid density sensor, and/or the like. The sensor 202 may be configured to detect a pH balance and/or an urea content of a fluid and may transmit a signal that indicates, and/or information identifying, the pH balance and/or urea content of the fluid to the ECM 206.

The fluid control device 204 is a device configured to control a flow of fluid. The fluid control device 204 may be a gate, a valve, and/or the like that can be actuated between an open state or position to permit a flow of the fluid and a closed state or position to prevent a flow of the fluid. For example, the fluid control device 204 may be actuated to control a flow of a fluid into and/or out of one or more portions of the hydraulic tank 300, such as the reservoir 302, the fill tube 304, and/or the conduit 306.

Alternatively, and/or additionally, the fluid control device 204 is a device configured to stop the operation of a machine associated with the hydraulic system 102 to control a flow of a fluid into and/or out of one or more portions of the hydraulic tank 300, such as the reservoir 302, the fill tube 304, and/or the conduit 306. For example, the fluid control device 204 may be a device configured to stop the operation of the machine 100 and/or the hydraulic system 102 to prevent a fluid from flowing out of the reservoir 302 and/or into the conduit 306.

The ECM 206 includes one or more processors and may execute software that permits the ECM 206 to provide signals to, or interpret signals from, one or more components of the hydraulic tank protection system 200. The one or more processors are implemented in hardware, firmware, or a combination of hardware and software and take the form of a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component.

The software permits the ECM 206 to receive a signal from the sensor 202, determine a type of a fluid based on the signal received from the sensor 202, provide a signal to the fluid control device 204 to actuate the fluid control device 204 between the open and closed positions, and/or provide a signal to the alert system 208 to cause the alert system 208 to perform an action as described below.

The alert system 208 is a system configured to receive a signal from the ECM 206 and to perform an action based on the received signal. The action may be any action intended to notify a user that a fluid has been determined to be a particular type of fluid and/or that a fluid has been determined not to be a particular type of fluid. For example, the action may include causing a set of one or more light emitting diodes (LEDs) to be illuminated, causing an audible message to be emitted via a speaker, preventing operation of the hydraulic system, preventing an operation of a vehicle associated with the hydraulic system, causing a notification to be transmitted to a user device, and/or the like.

As indicated above, FIG. 2 is provided as an example. Other examples may differ from what is described in connection with FIG. 2. For example, while the hydraulic tank protection system 200 is described as including a single sensor 202 and a single fluid control device 204, the hydraulic tank protection system 200 may include a plurality of sensors 202 and/or a plurality of fluid control devices 204.

Figure 3:
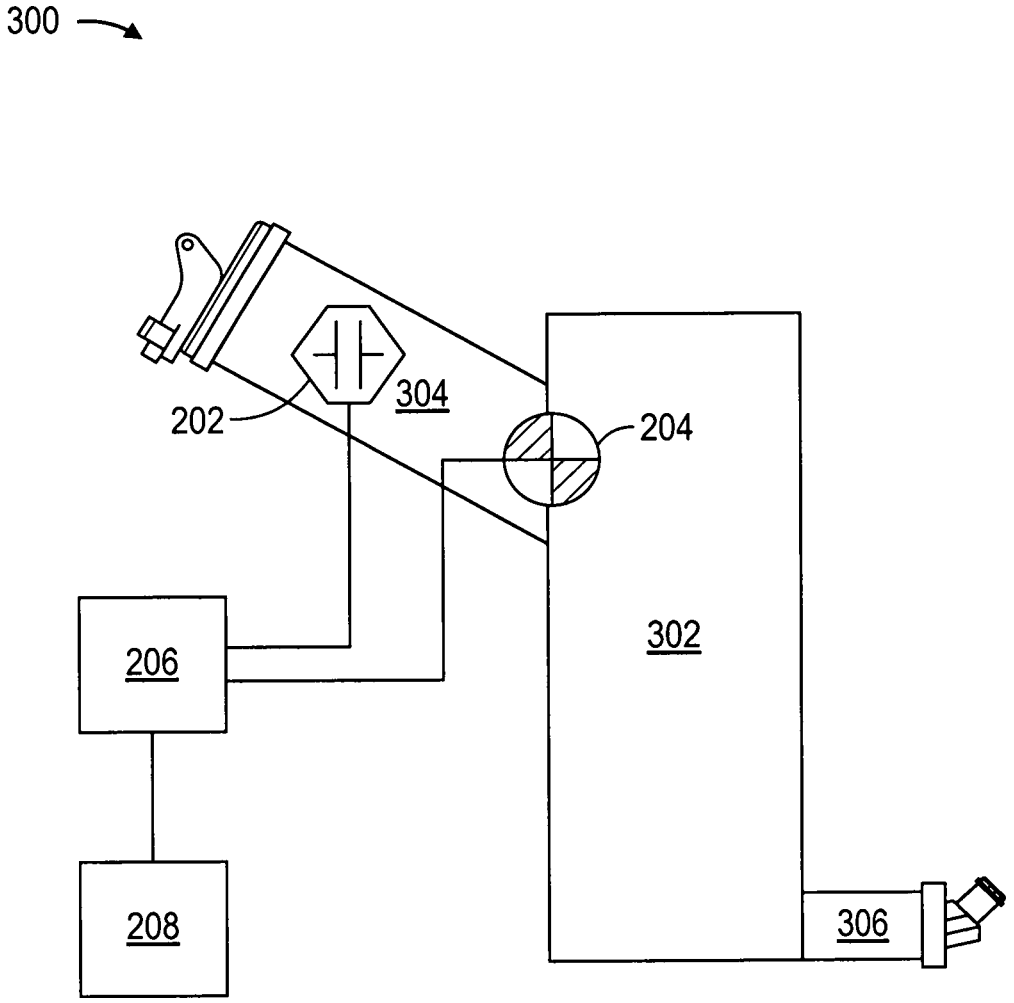
FIG. 3 is a diagram of an example hydraulic tank that includes a hydraulic tank protection system.

FIG. 3 is a diagram of an example hydraulic tank 300 that includes a hydraulic tank protection system 200. As shown in FIG. 3, the hydraulic tank 300 includes the reservoir 302, the fill tube 304, the conduit 306, the sensor 202, the fluid control device 204, the ECM 206, and the alert system 208.

The reservoir 302 is a container that holds hydraulic fluid, such as a petroleum-based hydraulic fluid, utilized by the hydraulic system 102. For example, a hydraulic fluid may be input into the hydraulic system via the fill tube 304. The fill tube 304 is a structure that allows the hydraulic fluid to flow into the reservoir 302. A pump (not shown) of the hydraulic system 102 causes the hydraulic fluid to be provided from the reservoir 302 to one or more actuators 114 of the hydraulic system 102 (and/or from the one or more actuators 114 and into the reservoir 302) via a conduit 306.

The hydraulic tank protection system 200 may control a flow of a fluid exiting the fill tube 304 and/or entering the reservoir 302. For example, a user may pour a fluid into the fill tube 304. As shown in FIG. 3, the sensor 202 may be located or positioned within the fill tube 304. As the fluid is being poured into the fill tube 304, the sensor 202 detects a characteristic of the fluid. In some implementations, the sensor 202 is a pH sensor and detects a pH level of the fluid. Alternatively, or additionally, the sensor 202 is an urea sensor and detects an urea content of the fluid and/or another property of the fluid.

Based on detecting the characteristic of the fluid, the sensor 202 transmits a signal to the ECM 206. The signal includes information identifying the detected characteristic of the fluid. The ECM 206 receives the signal and determines the characteristic of the fluid based on the included information. The ECM 206 determines a type of the fluid based on the characteristic of the fluid.

In some implementations, the ECM 206 determines a property of the fluid based on the characteristic. The ECM 206 determines a type of the fluid based on the property of the fluid.

For example, the signal may include information identifying the pH level of the fluid. The ECM 206 determines a type of the fluid based on determining whether the pH level of the fluid satisfies a threshold pH level.

Alternatively, or additionally, the signal may include information identifying an urea content of the fluid. The ECM 206 determines a type of the fluid based on the urea content of the fluid.

The ECM 206 determines a state or position of the fluid control device 204. For example, the ECM 206 determines whether the fluid control device 204 is in the open state or position or the closed state or position. Based on the fluid being DEF, and when the fluid control device 204 is in the open state or position, the ECM 206 transmits a signal to the fluid control device 204 to cause the fluid control device 204 to transition from the open state or position to the closed state or position to prevent the DEF from entering the reservoir 302.

When the fluid control device 204 is in the closed state or position, the ECM 206 transmits a signal to the fluid control device 204 to prevent the fluid control device 204 from transitioning from the closed state or position to the open state or position. Alternatively, when the fluid control device 204 is in the closed state or position, the ECM 206 may determine not to transmit a signal to the fluid control device 204.

As shown in FIG. 3, the fluid control device 204 may be positioned at or near an end of the fill tube 304 to control a flow of the fluid into the reservoir 302. The fluid control device 204 receives the signal transmitted by the ECM 206 and actuates (or refrains from actuating) into the open or closed state or position based on the signal.

As indicated above, FIG. 3 is provided as an example. Other examples may differ from what is described in connection with FIG. 3.

Figure 4:
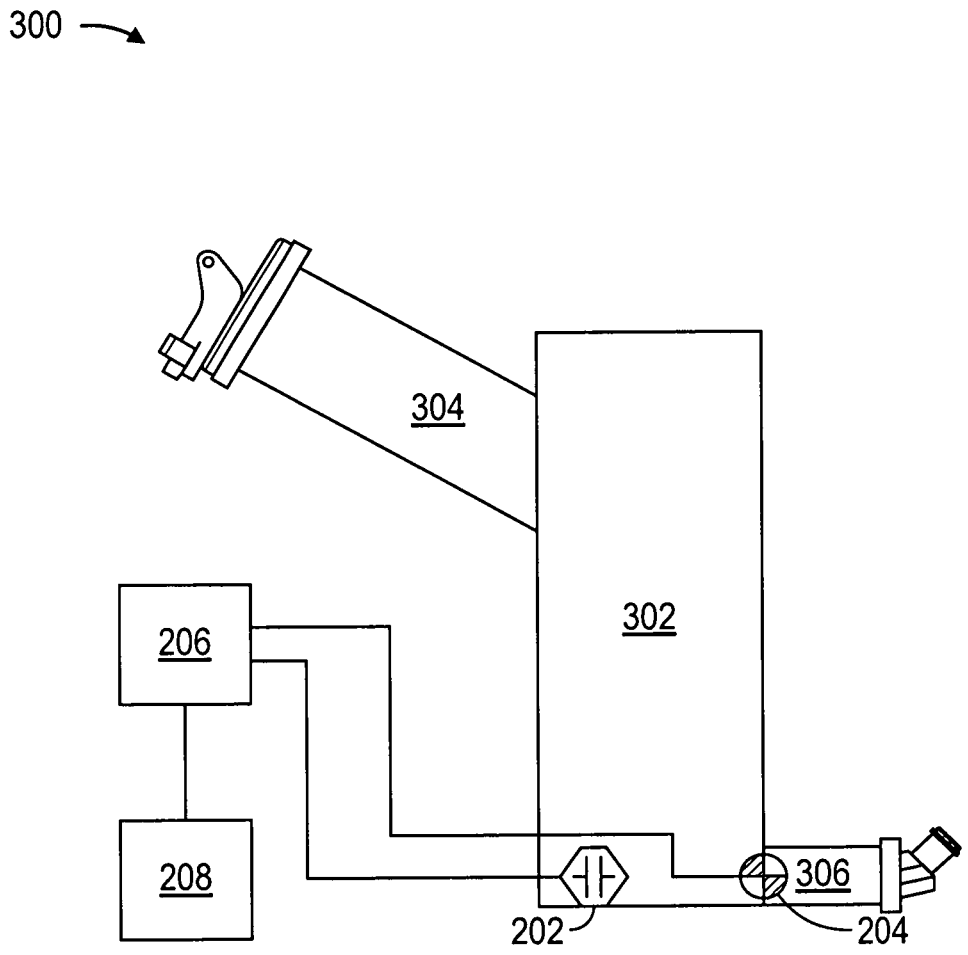
FIG. 4 is a diagram of an example hydraulic tank that includes a hydraulic tank protection system.

FIG. 4 is a diagram of an example hydraulic tank 300 that includes a hydraulic tank protection system 200. As shown in FIG. 4, the hydraulic tank protection system 200 may be located or positioned within the reservoir 302 to control a flow of a fluid exiting the reservoir 302 and/or entering the conduit 306. For example, a user may pour a fluid into the fill tube 304. The fluid may flow through the fill tube 304 and into the reservoir 302.

As the fluid enters the reservoir 302, and/or while the fluid is within the reservoir 302, the sensor 202 detects a characteristic of the fluid. To detect a characteristic of the fluid as the fluid enters the reservoir 302, the sensor 202 may be positioned in the reservoir 302 near or adjacent to an end of the fill tube 304. Because DEF is a denser fluid relative to hydraulic fluid, DEF may settle to be within a bottom portion of the reservoir 302. As shown in FIG. 4, to detect DEF within the reservoir 302, the sensor 202 may be positioned near (e.g., on and/or adjacent to) a bottom surface of the reservoir 302.

The sensor 202 may transmit a signal including information identifying the characteristic of the fluid to the ECM 206, in a manner similar to that as described above with respect to FIG. 3. The ECM 206 receives the signal and determines a type of the fluid in a manner similar to that described above with respect to FIG. 3.

The ECM 206 determines a state or position of the fluid control device 204. For example, the ECM 206 determines whether the fluid control device 204 is in the open state or position or the closed state or position. When the fluid is a type of fluid that is unwanted or harmful (e.g., DEF), and when the fluid control device 204 is in the open state or position, the ECM 206 transmits a signal to the fluid control device 204 to cause the fluid control device 204 to transition from the open state or position to the closed state or position to prevent the DEF from exiting the reservoir 302 and/or entering the conduit 306.

When the fluid is a type of fluid that is unwanted or harmful (e.g., DEF), and when the fluid control device 204 is in the closed state or position, the ECM 206 transmits a signal to the fluid control device 204 to prevent the fluid control device 204 from transitioning from the closed state or position to the open state or position. Alternatively, when the fluid control device 204 is in the closed state or position, the ECM 206 may determine not to transmit a signal to the fluid control device 204.

As shown in FIG. 4, the fluid control device 204 is positioned at or near an end of the conduit 306 to control a flow of the fluid exiting the reservoir 302 and/or entering the conduit 306. The fluid control device 204 may actuate to, or remain in, the open or closed state/position to control a flow of the fluid out of the reservoir 302 and/or into the conduit 306 based on the signal received from the ECM 206.

As indicated above, FIG. 4 is provided as an example. Other examples may differ from what is described in connection with FIG. 4.

Figure 5:
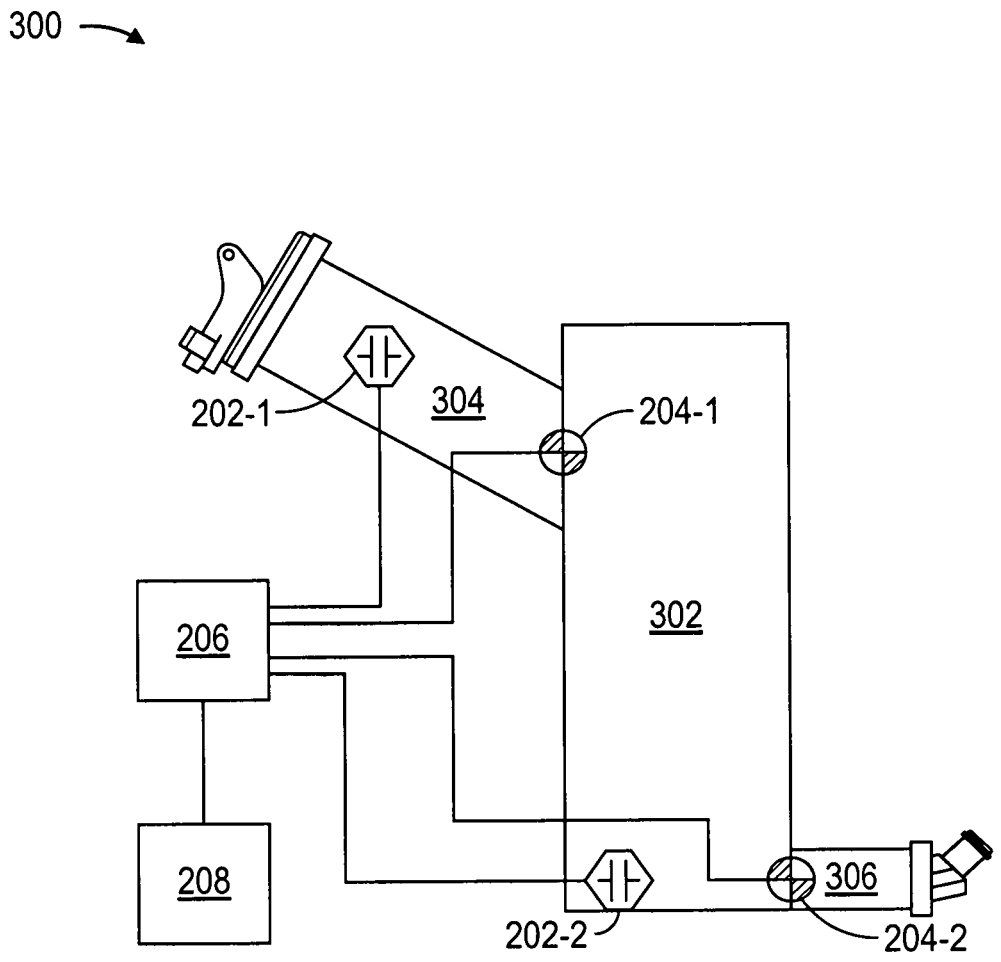
FIG. 5 is a diagram of an example hydraulic tank that includes a hydraulic tank protection system.

FIG. 5 is a diagram of an example hydraulic tank 300 that includes a hydraulic tank protection system 200. In some implementations, the hydraulic tank protection system 200 controls a flow of a fluid exiting the fill tube 304 (e.g., entering the reservoir 302) and controls a flow of a fluid exiting the reservoir 302 (e.g., entering the conduit 306). For example, as shown in FIG. 5, the hydraulic tank protection system 200 includes a sensor 202-1 and a fluid control device 204-1 positioned to control a flow of a fluid exiting the fill tube 304 and/or entering the reservoir 302 in a manner similar to that described above regarding FIG. 3. Additionally, the hydraulic tank protection system 200 includes a sensor 202-2 and a fluid control device 204-2 positioned to control a flow of a fluid exiting the reservoir 302 and/or entering the conduit 306 in a manner similar to that described above regarding FIG. 4.

In operation, the fluid control device 204-1 may be in an open state or position and a rate at which a type of fluid that is unwanted or harmful (e.g., DEF) flows through the fill tube 304 may be sufficient to allow a portion of the unwanted or harmful fluid to enter the reservoir 302 prior to the fluid control device 204-1 actuating into the closed state or position. The sensor 202-2 detects a characteristic of the portion of the unwanted or harmful fluid that entered into the reservoir 302 and transmits a signal to the ECM 206 that includes information identifying the characteristic of the portion of the unwanted or harmful fluid.

The ECM 206 determines a type (e.g., DEF) of the portion of the unwanted or harmful fluid based on the information identifying the characteristic of the portion of the unwanted or harmful fluid. The ECM 206 determines whether the fluid control device 204-2 is in the open state or position or the closed state or position. Based on the fluid being identified as a type of fluid that is unwanted or harmful, and when the fluid control device 204-2 is in the open state or position, the ECM 206 transmits a signal to the fluid control device 204-2 to cause the fluid control device 204-2 to transition from the open state or position to the closed state or position to prevent the portion of the unwanted or harmful fluid from exiting the reservoir 302 and/or entering the conduit 306.

When the fluid control device 204-2 is in the closed state or position, the ECM 206 transmits a signal to the fluid control device 204-2 to prevent the fluid control device 204-2 from transitioning from the closed state or position to the open state or position. Alternatively, when the fluid control device 204-2 is in the closed state or position, the ECM 206 may determine not to transmit a signal to the fluid control device 204-2.

As shown in FIG. 5, the fluid control device 204-2 is positioned at or near an end of the conduit 306 to control a flow of the fluid exiting the reservoir 302 and/or entering the conduit 306. The fluid control device 204-2 receives the signal transmitted by the ECM 206 and actuates (or refrains from actuating) into the open or closed state or position to prevent the portion of the unwanted or harmful fluid from exiting the reservoir 302 and/or entering the conduit 306.

As indicated above, FIG. 5 is provided as an example. Other examples may differ from what is described in connection with FIG. 5.

Figure 6:
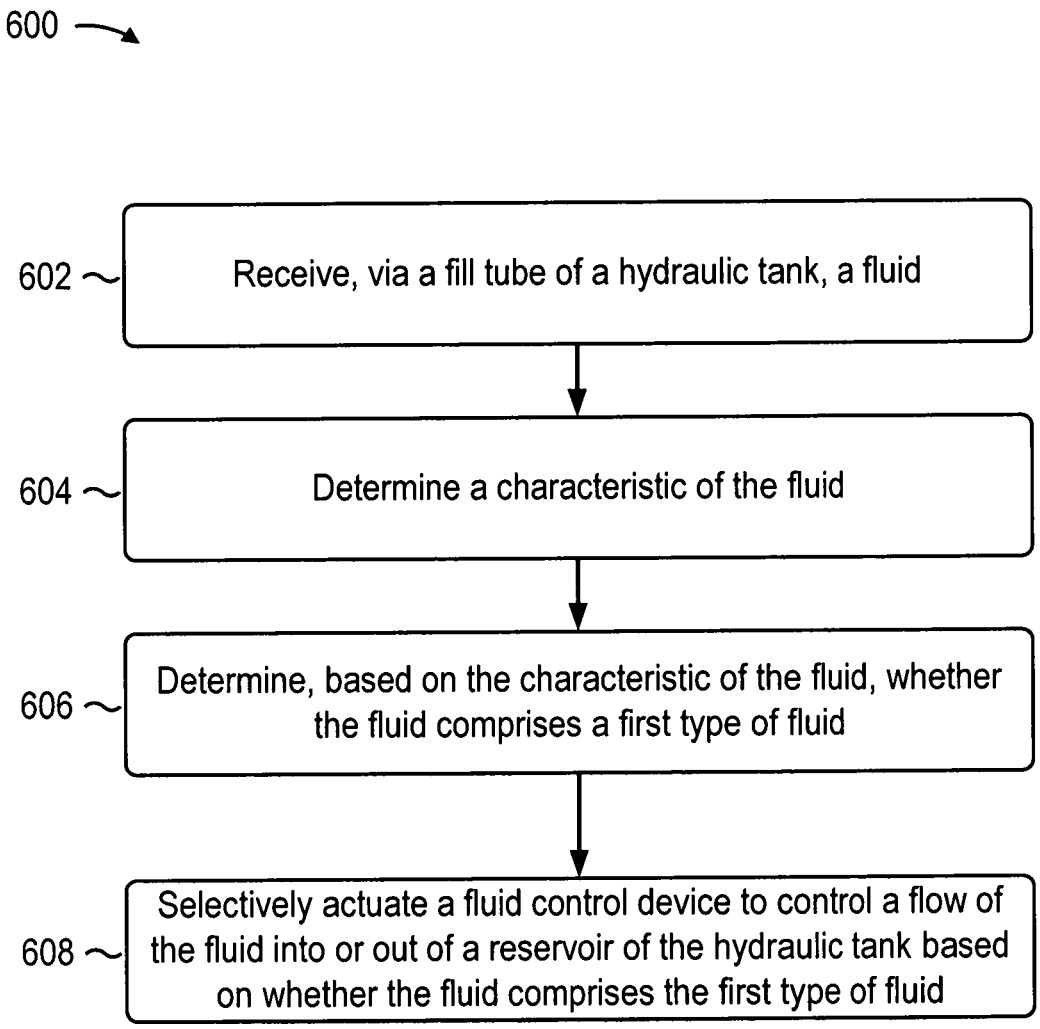
FIG. 6 is a flow chart of an example process for controlling a flow of a fluid into and/or out of a reservoir of a hydraulic tank.

FIG. 6 is a flow chart of an example process 600 for controlling a flow of a fluid into and/or out of a reservoir 302 of a hydraulic tank 300. In some implementations, one or more process blocks of FIG. 6 may be performed by a hydraulic tank protection system (e.g., hydraulic tank protection system 200).

As shown in FIG. 6, process 600 may include receiving, via a fill tube of a hydraulic tank, a fluid (block 602). For example, to add a fluid to a hydraulic system, fluid may be poured into a reservoir 302 of a hydraulic tank 300 via a fill tube 304 of the hydraulic tank 300, as described above.

As further shown in FIG. 6, process 600 may include determining a characteristic of the fluid (block 604). For example, a sensor 202 of the hydraulic tank protection system 200 may be a pH sensor, an urea sensor, and/or another type of sensor and may determine a characteristic of the fluid, such as a pH level, an urea content, and/or another property of the fluid, as described above.

As further shown in FIG. 6, process 600 may include determining, based on the characteristic of the fluid, whether the fluid comprises a first type of fluid (block 606). For example, the characteristic of the fluid may be a pH level and/or an urea content of the fluid and the ECM 206 may determine, based on the pH level and/or the urea content of the fluid, whether the fluid comprises a first type of fluid, such as DEF, as described above.

As further shown in FIG. 6, process 600 may include selectively actuating a fluid control device to control a flow of the fluid into or out of a reservoir of the hydraulic tank based on whether the fluid comprises the first type of fluid (block 608). For example, the ECM 206 may selectively actuate a fluid control device 204 to control a flow of the fluid into or out of the reservoir 302 of the hydraulic tank 300 based on whether the fluid comprises the first type of fluid, as described above.

Selectively actuating the fluid control device 204 may include closing, when the fluid comprises the first type of fluid, the fluid control device to prevent the fluid from entering the reservoir; opening, when the fluid comprises the first type of fluid, the fluid control device to permit the fluid to exit the reservoir; refraining from opening, when the fluid does not comprise the first type of fluid, the fluid control device to allow the fluid to enter the reservoir; or refraining from closing, when the fluid does not comprise the first type of fluid, the fluid control device to prevent the fluid from exiting the reservoir.

The hydraulic tank 300 may be operatively coupled to a machine 100 and when the fluid is determined to be the first type of fluid, an operation of the machine 100 may be prevented and/or an alert to a user of the machine 100 may be output, for example, by the alert system 208.

Process 600 may include additional implementations, such as any single implementation or any combination of implementations described above and/or in connection with one or more other processes described elsewhere herein.

Although FIG. 6 shows example blocks of process 600, in some implementations, process 600 may include additional blocks, fewer blocks, different blocks, or differently arranged blocks than those depicted in FIG. 6. Additionally, or alternatively, two or more of the blocks of process 600 may be performed in parallel.

INDUSTRIAL APPLICABILITY

The disclosed hydraulic tank protection system 200 may be used with any hydraulic system 102 where prevention of a particular type of fluid, such as DEF, from entering the hydraulic system 102 is desired. The disclosed hydraulic tank protection system 200 may determine a type of fluid entering and/or within a reservoir 302 of a hydraulic tank 300 and may actuate a fluid control device 204, such as a valve, a gate, and/or a device configured to stop an operation of a machine 100 associated with the hydraulic tank protection system 200, to control of a flow of the fluid into and/or out of the reservoir 302 based on the type of the fluid.

In this way, the hydraulic tank protection system 200 protects the hydraulic system 102 from damage and/or the inefficient or impaired operation of the hydraulic system 102 caused by the introduction of a harmful fluid, such as DEF, into the hydraulic system 102. By protecting the hydraulic system 102 from damage and/or the inefficient or impaired operation of the hydraulic system 102, the hydraulic tank protection system 200 protects a machine 100 utilizing the hydraulic system 102 (e.g., a cold planer) from damage and/or inefficient or impaired operation caused by the introduction of a harmful fluid, such as DEF, into the hydraulic system 102. Such damage and/or impairment may occur due to the harmful fluid negatively impacting parts of the hydraulic system 102 and/or the machine 100, causing mechanical failures (e.g., due to causing corrosion to of one or more metal parts of the hydraulic system 102) and/or the like. Accordingly, including the hydraulic tank protection system 200 with a hydraulic system 102 may lower costs of replacing equipment, maintenance, and/or repairs relative to previous hydraulic systems by preventing harmful fluids from entering and/or exiting the reservoir 302 of the hydraulic tank 300.

What is claimed is:

1. A method, comprising:

receiving, via a fill tube of a hydraulic tank, a fluid;

determining, by a sensor, a characteristic of the fluid;

determining, based on the characteristic of the fluid, whether the fluid comprises a first type of fluid; and selectively actuating a fluid control device to control a flow of the fluid into or out of a reservoir of the hydraulic tank based on whether the fluid comprises the first type of fluid.

2. The method of claim 1, wherein selectively actuating the fluid control device comprises one of:

closing, when the fluid comprises the first type of fluid, the fluid control device to prevent the fluid from entering the reservoir, or closing, when fluid comprises the first type of fluid, the fluid control device to prevent the fluid to exit the reservoir.

3. The method of claim 1, wherein selectively actuating the fluid control device comprises one of:

stopping an operation of a machine associated with the hydraulic tank, refraining from closing, when the fluid does not comprise the first type of fluid, the fluid control device to allow the fluid to enter the reservoir, or refraining from closing, when the fluid does not comprise the first type of fluid, the fluid control device to allow the fluid to exit the reservoir.

4. The method of claim 1, wherein determining the characteristic of the fluid comprises:

determining a property of the fluid; and wherein determining whether the fluid comprises the first type of fluid comprises:

determining whether the fluid comprises the first type of fluid based on the property of the fluid.

5. The method of claim 1, wherein determining the characteristic of the fluid comprises:

determining an urea content of the fluid; and wherein determining whether the fluid comprises the first type of fluid comprises:

determining whether the fluid comprises the first type of fluid based on the urea content of the fluid.

6. The method of claim 1, wherein the hydraulic tank is operatively coupled to a machine, the method further comprising:

preventing, when the fluid comprises the first type of fluid, an operation of the machine.

7. The method of claim 1, wherein the hydraulic tank is operatively coupled to a machine, the method further comprising:

outputting, when the fluid comprises the first type of fluid, an alert to a user of the machine.

8. A machine, comprising:

a hydraulic tank including:

a fill tube, and a reservoir; and a protection system including:

a sensor to detect a characteristic of a fluid, a fluid control device to control a flow of the fluid into or out of the reservoir, and an electronic control module to:

receive, from the sensor, information indicating the characteristic of the fluid, determine, based on the characteristic of the fluid, whether the fluid comprises a first type of fluid, and selectively provide a control signal to actuate the fluid control device to control the flow of the fluid into or out of the reservoir based on whether the fluid comprises the first type of fluid.

9. The machine of claim 8, wherein, when selectively actuating the fluid control device, the electronic control module is to:

prevent, when the fluid comprises the first type of fluid, the fluid control device from being in an open state to prevent the fluid from exiting at least one of the fill tube or the reservoir.

10. The machine of claim 8, wherein, when selectively actuating the fluid control device, the electronic control module is to:

prevent, when the fluid does not comprise the first type of fluid, the fluid control device from being in a closed state to allow the fluid to exit at least one of the fill tube or the reservoir.

11. The machine of claim 8, wherein the information indicating the characteristic of the fluid includes information indicating a pH level of the fluid; and wherein, when determining whether the fluid comprises the first type of fluid, the electronic control module is to:

determine whether the fluid comprises the first type of fluid based on the pH level of the fluid.

12. The machine of claim 8, wherein the information indicating the characteristic of the fluid includes information indicating an urea content of the fluid; and wherein, when determining whether the fluid comprises the first type of fluid, the electronic control module is to:

determine whether the fluid comprises the first type of fluid based on the urea content of the fluid.

13. The machine of claim 8, wherein the electronic control module is further to:

prevent, when the fluid comprises the first type of fluid, an operation of the machine.

14. The machine of claim 8, wherein, when determining whether the fluid comprises the first type of fluid, the electronic control module is to:

determine whether the fluid comprises a diesel exhaust fluid.

15. A cold planar, comprising:

a hydraulic tank including:

a reservoir, and a fill tube, wherein the fill tube allows a fluid to flow into the reservoir; and a protection system including:

at least one of:

a first fluid control device to control a flow of the fluid into the reservoir, or a second fluid control device to control a flow of the fluid out of the reservoir, a sensor to determine a characteristic of the fluid, and an electronic control module to:

receive a signal from the sensor, the signal indicating the characteristic of the fluid;

determine, based on the characteristic of the fluid, that the fluid comprises a first type of fluid; and selectively provide, based on whether the fluid comprises the first type of fluid, a control signal to actuate the at least one of the first fluid control device or the second fluid control device.

16. The cold planar of claim 15, wherein the sensor is located within the fill tube and wherein the at least one of the first fluid control device or the second fluid control device includes the first fluid control device.

17. The cold planar of claim 15, wherein the sensor is within the reservoir and wherein the at least one of the first fluid control device or the second fluid control device includes the second fluid control device.

18. The cold planar of claim 15, wherein, when determining that the fluid comprises the first type of fluid, the electronic control module is to:

determine that the fluid comprises a diesel exhaust fluid.

19. The cold planar of claim 15, wherein the signal indicates a pH level of the fluid; and wherein, when determining that the fluid comprises the first type of fluid, the electronic control module is to:

determine that the fluid comprises a diesel exhaust fluid based on the pH level of the fluid.

20. The cold planar of claim 15, wherein the signal indicates an urea content of the fluid; and wherein, when determining that the fluid comprises the first type of fluid, the electronic control module is to:

determine that the fluid comprises a diesel exhaust fluid based on the urea content of the fluid.

* * * * *